United States Patent [19]

Connizzoli et al.

[11] 4,064,707

[45] Dec. 27, 1977

[54] APPARATUS FOR PRE-FREEZING SUBSTANCES OF PRODUCTS INTENDED TO BE PRE-FREEZED

[76] Inventors: Mario Connizzoli, Via XX Settembre, 40, Brembio (Milan); Camillo Peviani, Vicclo Barni, 6, Lodi (Milan); Francesca Maietti, Via Raffaello 15, Casalpusterlengo (Milan), all of Italy

[21] Appl. No.: 666,504

[22] Filed: Mar. 12, 1976

Related U.S. Application Data

[62] Division of Ser. No. 451,273, March 14, 1974, abandoned.

[51] Int. Cl.[2] ..... F25D 17/02

[52] U.S. Cl. ..... 62/374; 62/380; 141/82; 141/129

[58] Field of Search ..... 62/63, 64, 374, 375, 62/380, 266, 345; 198/342; 141/82, 129

[56] References Cited

U.S. PATENT DOCUMENTS

| | | | |
|---|---|---|---|
| 1,458,991 | 6/1923 | Pique | 62/380 |
| 2,570,746 | 10/1951 | Bablik | 198/342 |
| 3,718,007 | 2/1973 | Randrup | 62/380 |

*Primary Examiner*—Ronald C. Capossela
*Attorney, Agent, or Firm*—Holman & Stern

[57] ABSTRACT

The freeze-drying of products, like foodstuffs or pharmaceuticals, and more particularly to a method and apparatus by which a plurality of containers is serially fed with a dosed amount of a first product after which the containers are passed in heat exchange relationship with a freezing bath and then further dosed amounts of different products are layered onto the firstly metered product and singularly pre-frozen, by passing through the same freezing bath.

4 Claims, 3 Drawing Figures

APPARATUS FOR PRE-FREEZING SUBSTANCES OF PRODUCTS INTENDED TO BE PRE-FREEZED

This is a divisional of application Ser. No. 451,273, filed Mar. 14, 1974, now abandoned.

BACKGROUND OF THE INVENTION

It is known that the substances or products which are intended to be freeze-dried, such as foodstuffs or pharmaceuticals, prior to being subjected to the freeze-drying process proper in evacuated cells, should be properly metered and pre-frozen. These two metering and pre-freezing stages have been carried out heretofore in a batchwise run, in different apparatus with the result being a considerable waste of time, especially when multi-layered products are to be pre-frozen, inasmuch as the metering and pre-freezing steps should be repeated for each layer of the product.

SUMMARY OF THE INVENTION

An object of the invention is to minimize the time required for carrying out these stages, by providing a method and an apparatus by which the metering and pre-freezing steps can be carried out as a continuous run for one or more layers of a product.

To achieve this object, according to the invention, it has been envisaged to provide a method comprising the following steps: feeding each at a time in a rowlike succession, a plurality of containers to a metering station, introducing in each container a preselected amount of the substance of the product to be freeze-dried and causing the container to be passed through a bath of a refrigerating fluid by keeping them hung at their tops.

Of course, when a substance or a product intended to be freeze-dried in more than one layer is concerned, this method is repeated as many times as there are layers, still operating "in line".

An apparatus for carrying out the method according to the invention may comprise, in combination: a feeding means for feeding one at a time in a rowlike succession, a plurality of containers to a metering station, a metering means for introducing in each container a predetermined amount of substance or product, a tub adapted to contain a bath of a refrigerating fluid and a means for guiding and hanging the containers while they are caused to pass through said bath.

The foregoing and other features, objects and advantages of the invention will become clearer from a scrutiny of the ensuing detailed description which illustrates, by way of nonlimiting example only, a preferred embodiment of an apparatus for carrying out the method according to the invention.

The description is given with reference to the diagrammatical accompanying drawings, wherein:

DETAILED DESCRIPTION OF THE INVENTION

Figure 1:
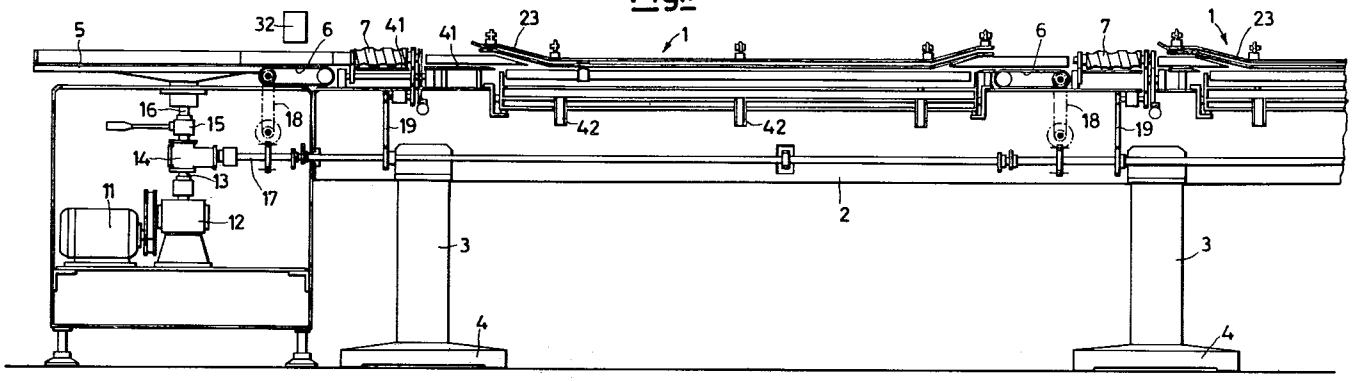
FIG. 1 is a view in side elevation which partially shows an apparatus according to the invention.
Figure 2:
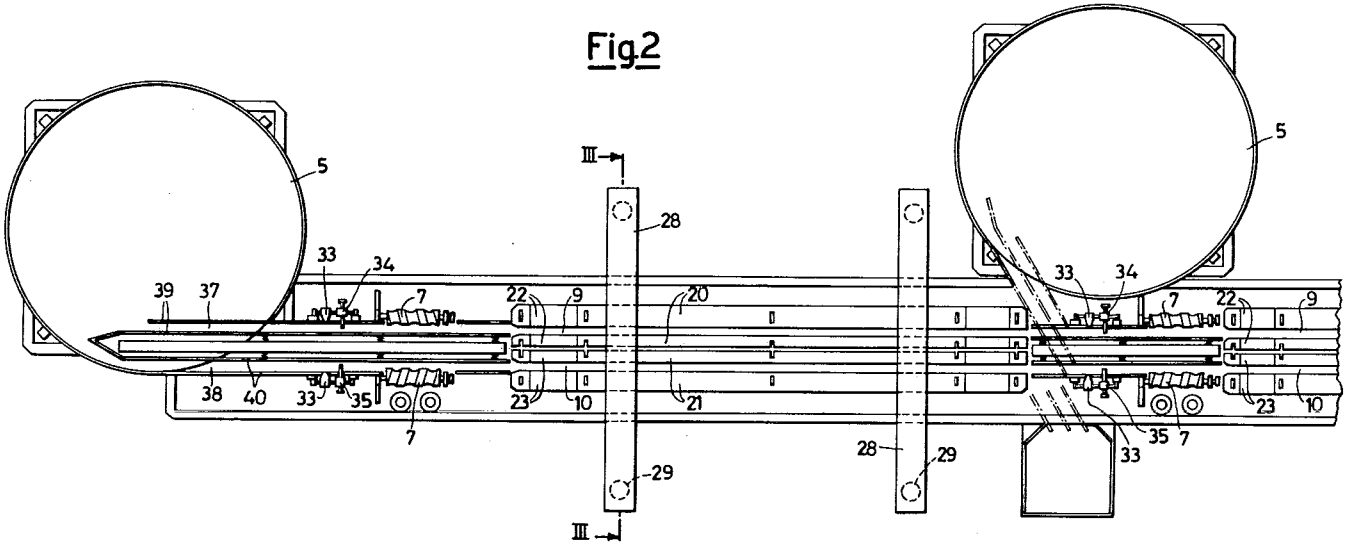
FIG. 2 is a plan view of the same apparatus.

With reference to the drawings, the apparatus is formed by a parallelepipedal elongate casing 2, supported by legs 3 provided with rest feet 4, and comprises a plurality of operative units 1 arranged in a row one after another and all equal to each other; Each unit 1 comprises a tray 5, a band conveyor 6, a couple of confrontingly mounted advancing screws 7, a tub 8 and two side-by-side guides 9, 10 placed above the tub 8.

The conveyor 6 and the screws 7 of all the units 1 can be driven to rotation continually by a single motor 11, through a speed variator 12, while the trays 5 have each have an individual motor. From the speed variator 12 emerges a driving shaft 13, which, through a 90° drive-transfer device 14 and a mechanical clutch 15, is connected to two transmission shafts 16, 17; The shaft 16 transfers the drive to the first tray 5, while the shaft 17 transfer the drive to the conveyor 6 and the screws 7 through two chain drive transfers 18, 19, respectively. As can clearly be seen in FIG. 1 of the drawings, the shaft 17 is a single one for all of the units.

The guides 9, 10 are formed, respectively, by two couples of rods 20, 21, which have relative end portions 22, 23 inclined upwards for a purpose which will be explained hereinafter.

Figure 3:
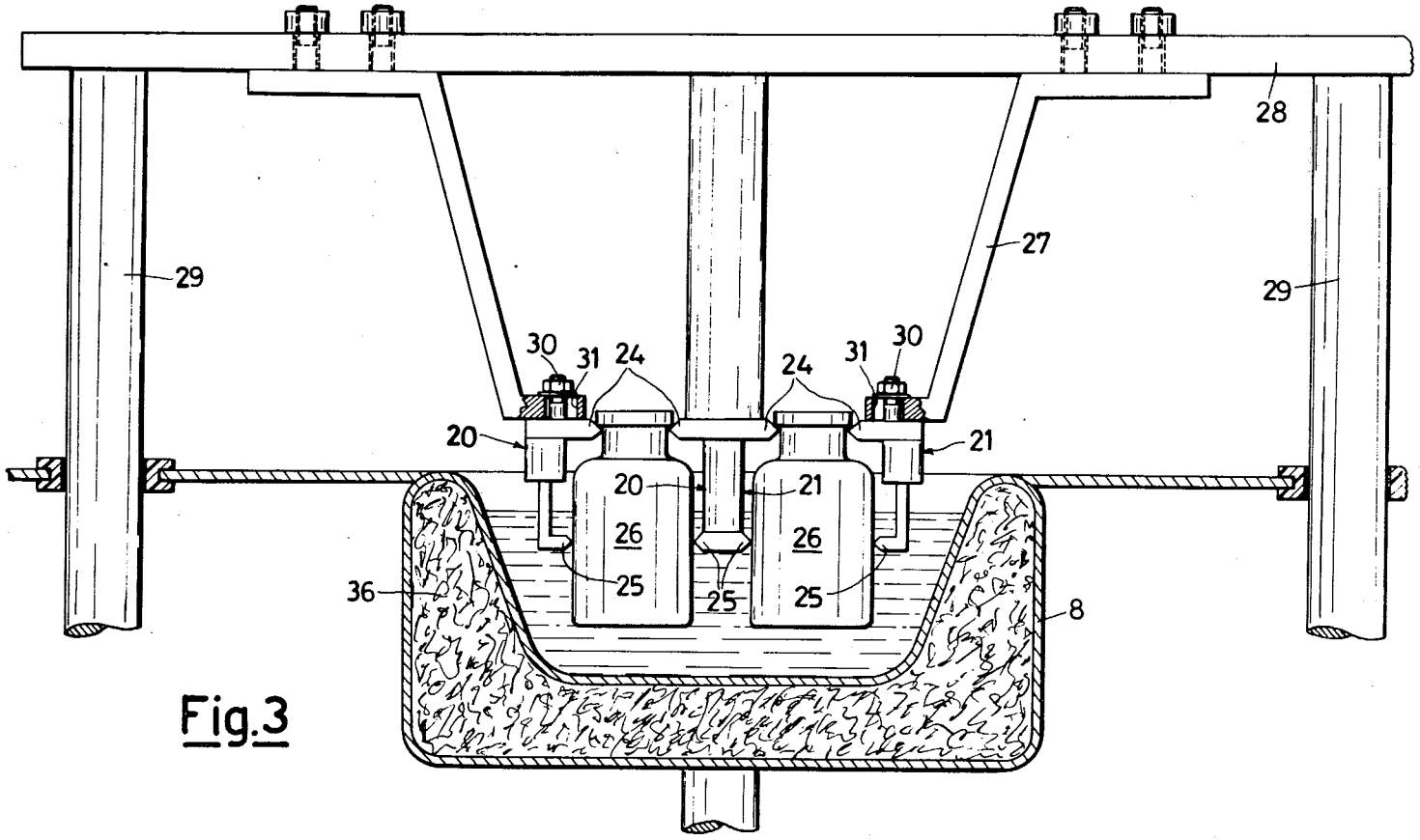
FIG. 3 is a cross-sectional view taken along the line III—III of FIG. 2., the view looking in the direction of the arrows.

In FIG. 3, it is clearly seen that the rods 20, 21 of each douple of rods have a substantially "C" shaped cross-section and webs 24, 25 of the "C" are confrontingly placed so as to make up the guides 9, 10 as mentioned above. The top webs 24 are intended to cooperate with the necks of a set of containers 26 and are longer than the bottom webs 25, with the latter webs being intended to cooperate with the bodies of the same containers 26.

The two couples of rods 20, 21 are supported by a plurality of stirrups 27 which are fastened in a central position to relative cross-ties 28 which, in turn, are affixed to the top of uprights 29 which are extended from the casing 2 and can be adjusted as to their vertical level. By so doing, it is possible to adjust the vertical level of the containers 26 with respect to the bottom of the tub 8, as a function of the heights of the same containers.

It is also possible to adjust the mutual distances between the rods of each couple as a function of the width or diameter of the containers 26; As a matter of fact, at least one of the rods 20, 21 is fastened to the relative stirrups 27 by means of bolts 30 which can be shifted within slots 31 formed through the stirrups 27.

The above mentioned conveyor 6 is a part of a metering station which comprises, : a metering unit as diagrammatically indicated at 32, a fluid feeler 33 and two confronting stop fingers 34, 35.

The fingers 34, 35 are movable each between an extracted position where they stop each container 26 lies exactly beneath the metering unit 32, and a retracted position where they permit a container to be fed forward in the machine.

As can clearly be seen in FIG. 3, the tub 8 is properly coated with a heat-insulating material 36 and is adapted to contain a refrigerating fluid, such as liquid nitrogen, which is fed through inlet ducts 42.

The operation of the apparatus as described above is as follows.

When the apparatus is in operation, the trays 5, the conveyors 6 and the screws 7 are rotated continually. On each tray 5, a plurality of containers or vials 26 are placed, which are conveyed by the rotation of the tray so as to enter, in rowlike succession, two runways 37, 38 which are parallel to one another. These runways 37, 38 are formed, respectively, by two couples of flanks 38, 40, and are aligned with the guideways 9 and 10 and guide the flasks on the conveyor 6 which is coplanar with the tray 5. It will be understood that the advance of the two rows of containers along the runways 37, 38 up to the conveyor 6, takes place on account of the thrust imparted by the flasks as fed one at a time from the tray 5 to the previously fed-in ones. The two rows of flasks thus reach the conveyor 6 which causes them to be fed forward up to about one half of its length where the two first flasks meet the stop fingers 34, 35, respectively, which have been pushed out, and stop the advance of the two rows while the conveyor 6 continues to be rotated by friction on the bottoms of the flask. At this stage, the metering unit 32 enters action to introduce in the first flasks a predetermined amount of substance or product intended to be pre-frozen and then freeze-dried. On completion of the metering operation, the fingers 34, 35 are drawn in to permit the advance of the two head flasks which have been filled, to be returned then immediately to their pushed out position to stop the next two flasks between the metering unit 32, and so forth in such a way as not to stop the continuity of the two flask rows.

By doing so, the two rows of filled flasks are brought from the conveyor 6 on a plane of sliding 41 in correspondence with the relatively rotating screws 7 which cause the flasks to be advanced to enter the guideways 9, 10 as clearly shown in FIG. 3. As can clearly be seen in FIG. 1, the inclined end portion 22 of the guides 9, 10 leads the flasks 26 to be immersed in the tub 8 which contains the refrigerating fluid bath while the end portion 23 carries the flasks out of the tube to a collecting station. The advance of the flasks along the guides 9, 10 takes place due to the thrust the two rows receive from the screws 7.

The product as contained in the flasks emerging from the bath is thus pre-frozen and the flasks can be sent directly to freeze-drying or to other metering and pre-freezing units of further layers of product above the first layer.

The fluid feeler 33 serves to feel the flasks which do not reach the metering unit so as to cause the stoppage of the machine.

In the drawings, an apparatus has been shown having more than one metering and pre-freezing unit and with two parallel rows of flask feed, but, of course, the machine could also comprise a single metering and pre-freezing unit with a single flask-feeding row, without changing anything at least from a conceptual point of view.

In addition, the structure of the machine described above to carry out the method of pre-freezing according to the invention is not a limitation in that many changes are possible therein. For example, it can be circular, using other means for conveying the containers, such as special tongs, systems which use the vacuum, or any other system which is apt to ensure the feed of the containers.

The advantages of such an embodiment can be thus summarized:

The continuous metering and pre-freezing process is much quicker than the conventional methods, due to the continuity and the speed of the method, it is possible to meter and pre-freeze without difficulties plural layers of products or substances in the same flask without any risk that the previously pre-frozen layer at low temperature can become admixed with the dosage unit of the product poured thereon and which has a higher temperature and the structure of the apparatus is such that in a minimum space it is possible to handle a large number of flasks.

What is claimed is:

1. An apparatus for prefreezing substances or products intended to be freeze-dried, comprising in combination: a feeding means for feeding one at a time in row-like succession a plurality of containers to a metering station, said containers having a neck and a body, a metering means for introducing in each container a predetermined amount of substance or product, a tube adapted to contain a refrigerating fluid bath, a guiding and suspension means for the containers while they are being passed through said bath and thrust means to cause the containers to be advanced through the bath, said suspension and guiding means comprising at least one pair of parallel rods having substantially C-shaped cross-sections, said rods being arranged with the bent portions of each C facing those of the other C so as to form upper support means able to engage the neck of the containers and lower support means able to engage the body of the containers.

2. An apparatus according to claim 1, wherein said suspension and guiding means further comprises members, each having a central portion which is at a lower level than two end portions inclined upwards, one of said inclined end portions serving to bring said containers from the metering station partially into the bath, the other portion serving conversely to bring said containers out of the bath to a collecting station.

3. An apparatus according to claim 1, wherein said thrust means are formed by at least one screw.

4. An apparatus according to claim 1 wherein said feeding means is a band conveyor cooperating with a stop means for each container, under said metering means, while said conveyor is continually rotated with friction on the bottom of the containers.

* * * * *